US008680956B2

(12) United States Patent
Kim et al.

(10) Patent No.: US 8,680,956 B2
(45) Date of Patent: Mar. 25, 2014

(54) ELECTROMAGNET DEVICE AND SWITCH DEVICE USING ELECTROMAGNET DEVICE

(75) Inventors: Taehyun Kim, Tokyo (JP); Tomotaka Yano, Tokyo (JP); Masahiro Arioka, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/395,210

(22) PCT Filed: Oct. 29, 2009

(86) PCT No.: PCT/JP2009/005745

§ 371 (c)(1),
(2), (4) Date: Mar. 9, 2012

(87) PCT Pub. No.: WO2011/052011

PCT Pub. Date: May 5, 2011

(65) Prior Publication Data

US 2012/0169441 A1 Jul. 5, 2012

(51) Int. Cl.
*H01H 9/00* (2006.01)

(52) U.S. Cl.
USPC ..... 335/179

(58) Field of Classification Search
USPC ..... 335/174–179; 218/1, 7, 14, 48, 49, 57, 218/65, 78, 84, 92, 118, 120, 140, 154
See application file for complete search history.

(56) References Cited

U.S. PATENT DOCUMENTS

| | | | | |
|---|---|---|---|---|
| 6,020,567 | A * | 2/2000 | Ishikawa et al. | 218/154 |
| 6,373,675 | B1 * | 4/2002 | Yamazaki et al. | 361/135 |
| 7,911,303 | B2 * | 3/2011 | Morita et al. | 335/174 |
| 7,982,567 | B2 * | 7/2011 | Cartier Millon et al. | 335/229 |
| 8,159,806 | B2 * | 4/2012 | Cartier-Millon et al. | 361/139 |
| 8,179,217 | B2 * | 5/2012 | Kawaguchi et al. | 335/80 |
| 2005/0139579 | A1 | 6/2005 | Sakamoto et al. | |
| 2009/0039989 | A1 * | 2/2009 | Reuber | 335/127 |

FOREIGN PATENT DOCUMENTS

| | | | |
|---|---|---|---|
| JP | 35-13270 | B1 | 9/1960 |
| JP | 1-286301 | A | 11/1989 |
| JP | 2000-164084 | A | 6/2000 |
| JP | 2002-140966 | A | 5/2002 |

(Continued)

OTHER PUBLICATIONS

International Search Report (PCT/ISA/210) issued on Dec. 8, 2009, by Japanese Patent Office as the International Searching Authority for International Application No. PCT/JP2009/005745.

(Continued)

*Primary Examiner* — Bernard Rojas
(74) *Attorney, Agent, or Firm* — Buchanan Ingersoll & Rooney PC

(57) ABSTRACT

In a switch device in which the main circuit contact sections of the switch device, an insulating rod, a driving rod, a contact pressure spring, an open spring, and an electromagnet are all coaxially arranged, a problem exists in that the axial dimension of the switch device becomes large. The present invention has been made to solve the aforementioned problem. An object is to obtain an electromagnet device and a switch device using the electromagnet device, in which shortening the axial dimension of the switch device is achieved by arranging the main circuit contact sections of the switch device, the insulating rod, the driving rod, the contact pressure spring, the open spring, and a part of the electromagnet in the same axial range. Particularly, the open spring and the electromagnet are arranged in the same axial region.

17 Claims, 12 Drawing Sheets

(56) References Cited

FOREIGN PATENT DOCUMENTS

| | | | |
|---|---|---|---|
| JP | 2003-151826 | A | 5/2003 |
| JP | 2009-049231 | A | 3/2009 |
| JP | 4277198 | B2 | 6/2009 |

OTHER PUBLICATIONS

Office Action dated Apr. 25, 2013 issued by the Korean Patent Office in corresponding Korean Patent Application No. 10-2012-7010869, and an English translation thereof.

* cited by examiner

ELECTROMAGNET DEVICE AND SWITCH DEVICE USING ELECTROMAGNET DEVICE

TECHNICAL FIELD

The present invention relates to an electromagnet device which displaces a movable core with respect to a fixed core by energization to an electromagnetic coil and relates to a switch device which opens and closes contacts by the driving force of the electromagnet device, the switch device being used for electric power transmission/distribution and reception facilities.

DESCRIPTION OF THE RELATED ART

In some switch devices which open and close contacts by the driving force of an electromagnet device, the electromagnet device and main circuit contact sections of the switch device are coaxially arranged and a merit which can reduce transfer loss due to a connection mechanism is provided. In the thus configured switch device, the main circuit contact sections of the switch device, an insulating rod, a driving rod, a contact pressure spring which applies a contact pressure to main circuit contacts, an open spring which generates a load of an opening direction at a movable contact of the main circuit contacts, and a movable shaft of the electromagnet device are all coaxially arranged. (For example, see Patent Document 1.)

RELATED ART DOCUMENT

Patent Document

Patent Document 1: Japanese Examined Patent Publication No. 4277198

DISCLOSURE OF THE INVENTION

Problems to be Solved by the Invention

In the switch device in which the electromagnet device and the main circuit contact sections of the switch device are coaxially arranged, a problem exists in that the main circuit contact sections of the switch device, the insulating rod, the driving rod, the contact pressure spring, the open spring, and an electromagnet are all coaxially arranged; and therefore, the axial dimension of the switch device becomes large.

The present invention has been made to solve the aforementioned problem, and an object of the present invention is to obtain an electromagnet device capable of shortening the axial dimension of a switch device and a switch device using the electromagnet device.

Means for Solving the Problems

Main circuit contact sections of a switch device, an insulating rod, a driving rod, a contact pressure spring, an open spring, and a part of an electromagnet are arranged in the same axial range. More particularly, the open spring and the electromagnet are arranged in the same axial region.

Advantageous Effect of the Invention

The whole length of summation of the electromagnet and the open spring can be shortened and reduction in size of the switch device can be achieved.

MODE FOR CARRYING OUT THE INVENTION

Implemental Example 1

Embodiment 1

Figure 1:
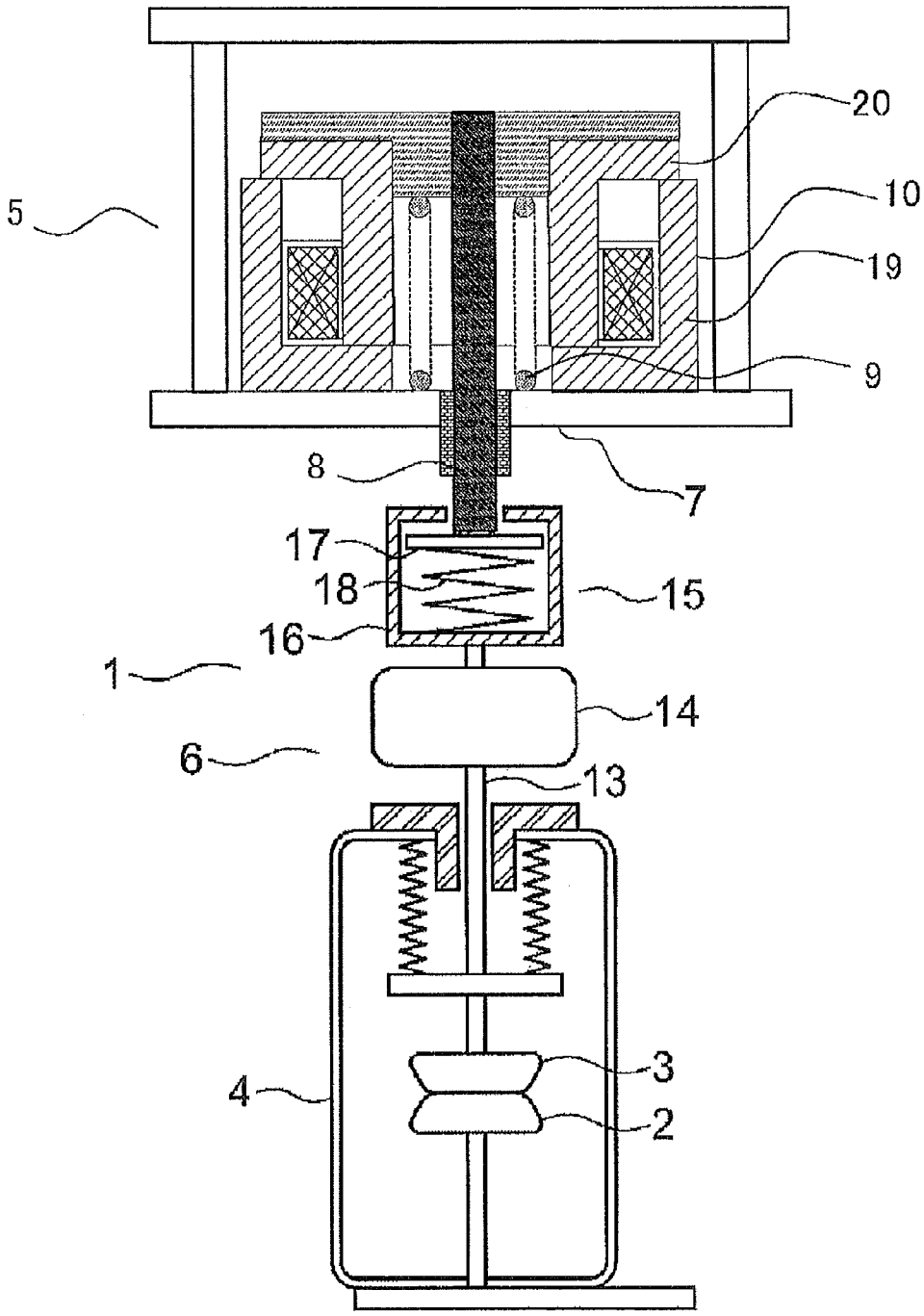
FIG. 1 is a front sectional view showing a switch device according to Embodiment 1 of the present invention.
Figure 2:
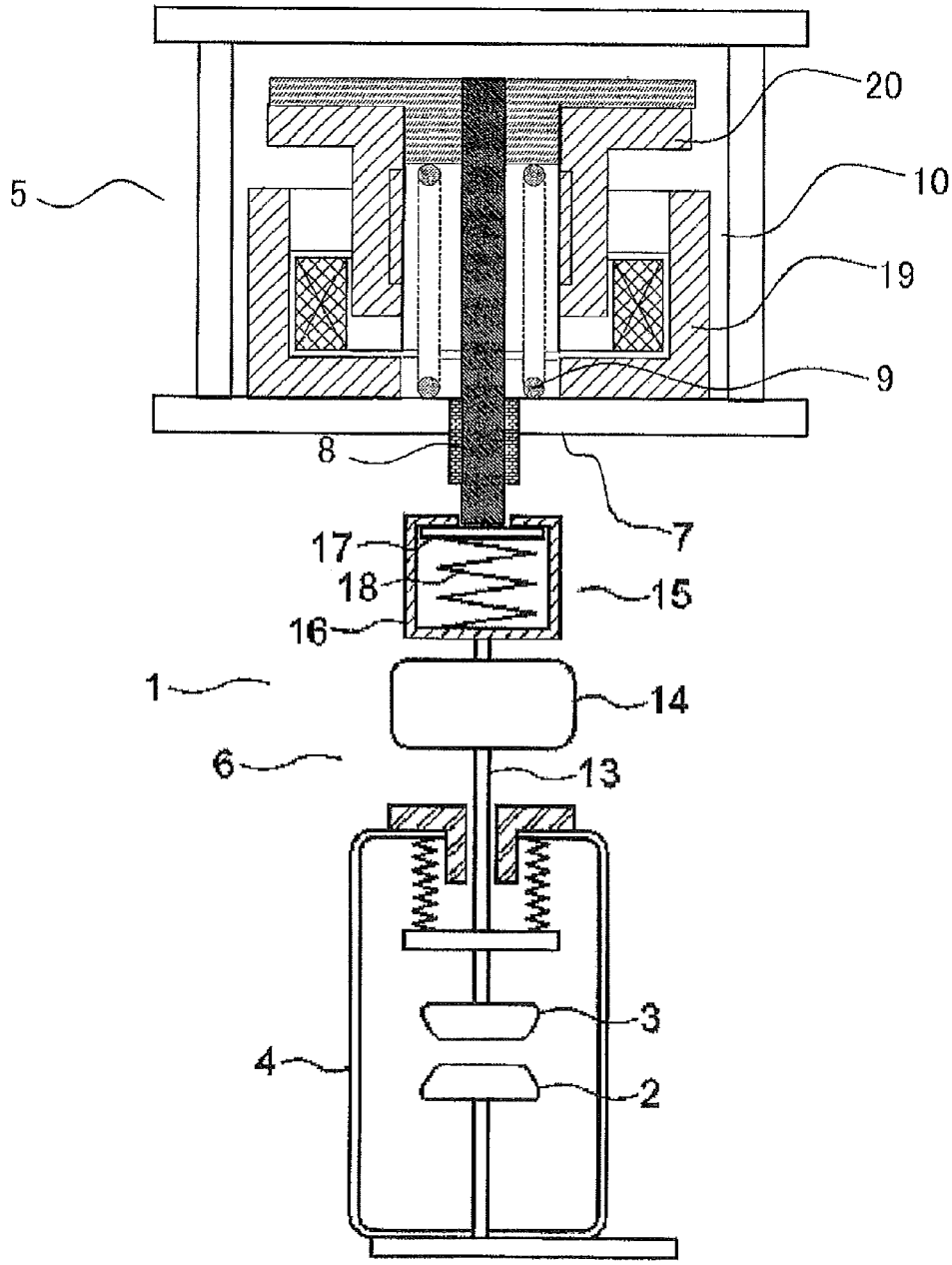
FIG. 2 is a front sectional view showing a state where contacts of the switch device of FIG. 1 are closed (close contact state)

FIG. 1 is a front sectional view showing a switch device according to Embodiment 1 of the present invention. Furthermore, FIG. 2 is a longitudinal sectional view showing a state where contacts of the switch device of FIG. 1 are closed (close contact state). Incidentally, FIG. 1 is a view showing a state where the contacts of the switch device are opened (opened state). In the drawings, a switch device 1 has a fixed contact 2, a movable contact 3 capable of coming into contact with or separating from the fixed contact 2, a vacuum valve 4 which contains the fixed contact 2 and the movable contact 3, an electromagnet device 5 which displaces the movable contact 3 in a direction coming into contact with or separating from the fixed contact 2, and a connection device 6 which connects the electromagnet device 5 to the movable contact 3.

The movable contact 3 comes into contact with or separates from the fixed contact 2 by displacement in an axis line direction (hereinafter, merely referred to as "axis line direction") of the switch device 1. Contacts of the switch device 1 are closed by the fact that movable contact 3 comes into contact with the fixed contact 2, and the contacts are opened by the fact that movable contact 3 separates from the fixed contact 2.

The inside of the vacuum valve 4 is kept under vacuum in order to improve arc suppression performance between the fixed contact 2 and the movable contact 3. The movable contact 3 comes into contact with or separates from the fixed contact 2 in the vacuum valve 4. When the movable contact 3 is separated from the fixed contact 2, the inside of the vacuum valve 4 is kept under vacuum and accordingly the inside becomes negative pressure; and thus, a force in which the movable contact 3 tries to close to the fixed contact 2 is exerted.

The electromagnet device 5 is supported by a plate-like support member 7. Furthermore, the electromagnet device 5 has a driving shaft 8 connected to the movable contact 3 via the connection device 6, an open spring (biasing body) 9 which biases the driving shaft 8 to a direction in which the movable contact 3 separates from the fixed contact 2, and an electromagnet 10 which displaces the driving shaft 8 to a direction in which the movable contact 3 comes into contact with the fixed contact 2 against a load of the open spring 9.

The driving shaft 8 passes through the support member 7 so as to be capable of displacing in the axis line direction. Furthermore, the driving shaft 8 is made of a material with low permeability (low magnetic material), such as stainless material. The electromagnet 10 is provided with a fixed core 19 and a movable core 20 to which the driving shaft 8 is fixed, the movable core 20 being capable of displacing in the axis line direction with respect to the fixed core 19.

The open spring 9 is compressed between the movable core 20 and the support plate 7 to generate an elastic repulsive force in the axis line direction. Therefore, the driving shaft 8 is biased to a direction in which the movable contact 3 separates from the fixed contact 2 by the elastic repulsive force of the open spring 9, the elastic repulsive force being to be exerted on the movable core 20.

The electromagnet 10 is mounted on the support member 7. The driving shaft 8 is selectively displaced by the fact that the electromagnet 10 is controlled in either direction in which the movable contact 3 comes into contact with the fixed contact 2 (contact closing direction) or direction in which the movable contact 3 separates from the fixed contact 2 (opening direction).

The connection device 6 has a movable rod 13 which is located in the axis line direction and fixed to the movable contact 3, an insulating rod 14 placed in an intermediate portion of the movable rod 13, and a contact pressure device 15 placed between the movable rod 13 and the driving shaft 8. The movable rod 13 is separated and fixed to both end sections of the insulating rod 14 placed in the intermediate portion; and accordingly, the movable rod 13 is electrically insulated. Therefore, the electromagnet device 5 is insulated by the insulating rod 14 with respect to the movable contact 3.

The contact pressure device 15 has a spring frame 16 fixed to the movable rod 13, a latch plate 17 which is fixed to an end section of the driving shaft 8 and located in the spring frame 16, and a contact pressure spring 18 shrunk and connected between the spring frame 16 and the latch plate 17.

The driving shaft 8 is capable of displacing in the axis line direction with respect to the spring frame 16 together with the latch plate 17. The contact pressure spring 18 biases the driving shaft 8 to a direction to be separated from the movable rod 13. Displacement of the driving shaft 8 to the direction to be separated from the movable rod 13 is regulated by engagement of the latch plate 17 with respect to the spring frame 16.

The movable core 20 is capable of displacing between a backward movement position separated from the fixed core 19 (FIG. 1) and a forward movement position closer to the fixed core 19 than the backward movement position (FIG. 2). The movable contact 3 is separated from the fixed contact 2 when the movable core 20 is at the backward movement position; and the movable contact 3 is pressed to the fixed contact 2 when the movable core 20 is at the forward movement position.

In the case where the movable contact 3 is separated from the fixed contact 2 (FIG. 1), and when the driving shaft 8 is displaced in the axis line direction, the connection device 6 and the movable contact 3 are displaced together with the driving shaft 8. At this time, the latch plate 17 is engaged with the spring frame 16 by a load of the contact pressure spring 18. Furthermore, when the movable contact 3 comes into contact with the fixed contact 2 (FIG. 2), the driving shaft 8 is further capable of displacing in a contact closing direction with respect to the spring frame 16 against the load of the contact pressure spring 18. Accordingly, the contact pressure spring 18 is further shrunk and the movable contact 3 is pressed to the fixed contact 2 by the elastic repulsive force of the contact pressure spring 18.

When a contact closing operation is performed from a state where the movable contact 3 is separated from the fixed contact 2, the driving shaft 8 is displaced to the contact closing direction together with the connection device 6 and the movable contact 3 as the open spring 9 is shrunk. After that, when the movable contact 3 comes into contact with the fixed contact 2, the displacement of the connection device 6 and the movable contact 3 is stopped. Also, after that, the driving shaft 8 is further displaced to the contact closing direction and the contact pressure spring 18 is shrunk. Accordingly, the movable contact 3 is pressed to the fixed contact 2.

When an opening operation is performed from a state where the movable contact 3 comes into contact with the fixed contact 2, the driving shaft 8 is displaced to the opening direction as the open spring 9 and the contact pressure spring 18 are elastically restored. Accordingly, the latch plate 17 is displaced with respect to the spring frame 16 to be engaged with the spring frame 16. Also, after that, the driving shaft 8 is further displaced to the opening direction by the load of the open spring 9. Accordingly, the movable contact 3 is separated from the fixed contact 2.

Figure 3:
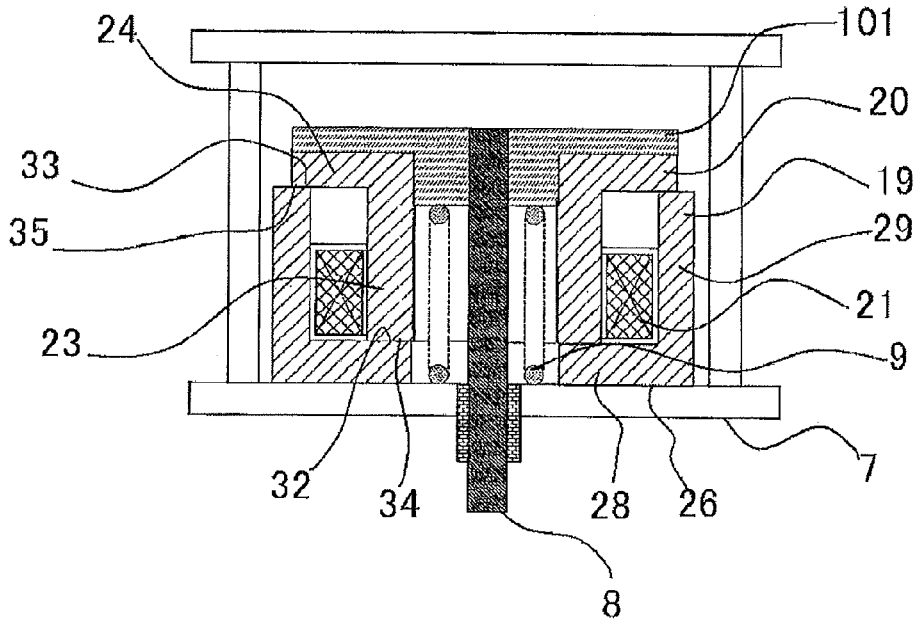
FIG. 3 is a front sectional view showing main portions around an electromagnet 10 in an electromagnet device 5 of FIG. 2.
Figure 4:
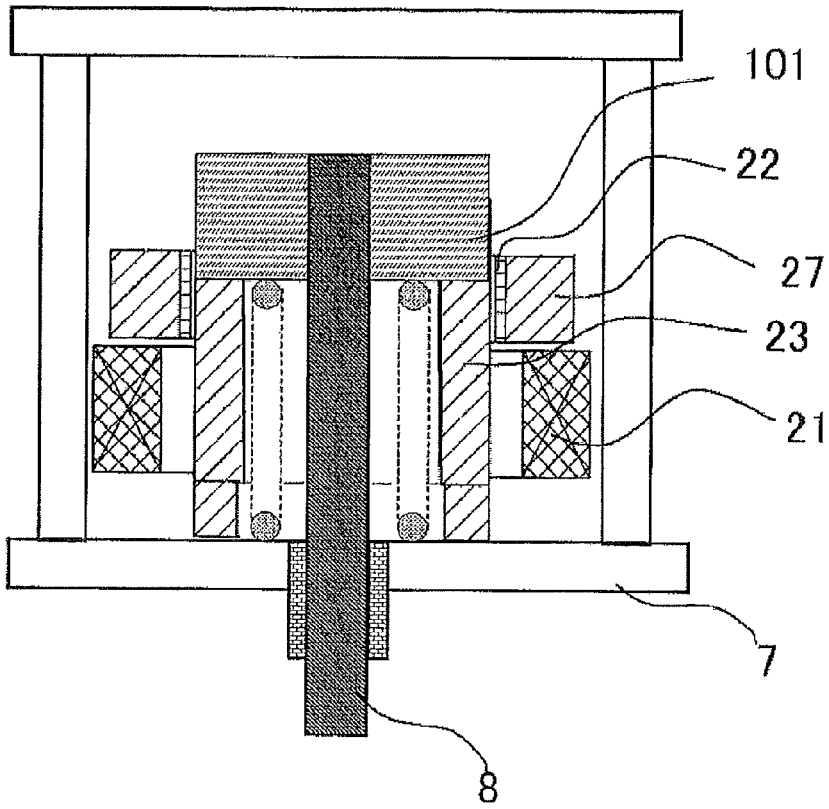
FIG. 4 is a side sectional view of FIG. 3.
Figure 5:
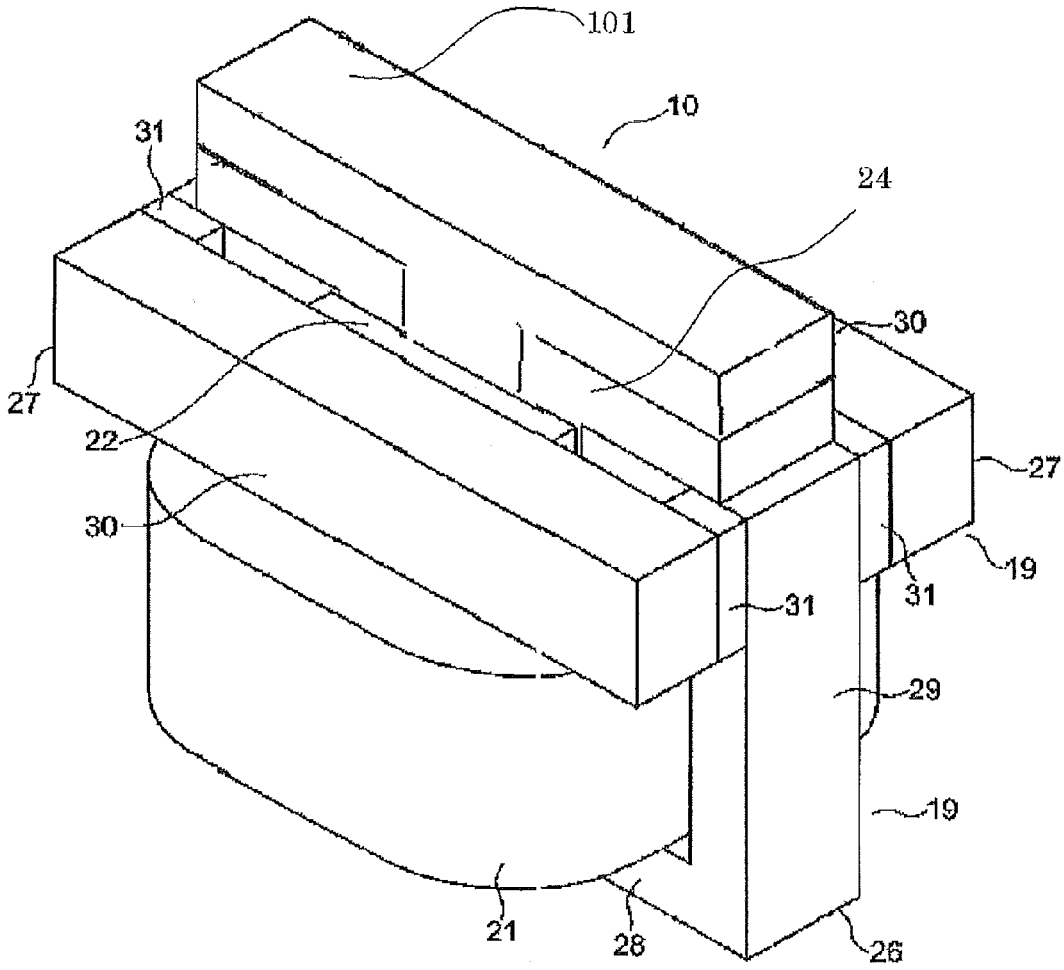
FIG. 5 is a perspective view of the electromagnet 10 in FIG. 3.

FIG. 3 is a front sectional view showing main portions of the periphery of the electromagnet 10 in the electromagnet device 5 of FIG. 2; and FIG. 4 is a side sectional view of FIG. 3. FIG. 5 is a perspective view of the electromagnet 10 in FIG. 3. In the drawings, the electromagnet 10 has the fixed core 19; the movable core 20 to which the driving shaft 8 is fixed, the movable core 20 being capable of displacing in the axis line direction with respect to the fixed core 19; an electromagnetic coil 21 which is placed on the fixed core 19 and generates a magnetic field by energization; and permanent magnets 22 placed on the fixed core 19. The open spring 9 is coaxially located with the driving shaft 8 and is compressed between the movable core 20 and the support plate 9.

The movable core 20 has major portions 23 arranged along the axis line direction; a pair of branch portions 24 which protrude in the opposite directions with each other from each side surface of the major portions 23, and a bulk material portion 101 which is connected to the driving shaft 8 and comes into contact with one seating surface of the open spring 9. Each of the major portions 23 is arranged parallel to the axis line direction on the outer position than the open spring 9 centering on the driving shaft 8. Each branch portion 24 protrudes from the major portion 23 along a direction perpendicular to the axis line direction. The driving shaft 8 is fixed to the movable core 20 by being fixed to the bulk material portion 101.

The fixed core 19 has a first fixed core portion 26 and a pair of second fixed core portions 27 which are provided on the first fixed core portion 26 and arranged avoiding a region where the movable core 20 displaces (FIG. 5).

The first fixed core portion 26 has a lateral core portion 28 which is located parallel to each branch portion 24 and a pair of longitudinal core portions 29 which extend toward each branch portion 24 from both end sections of the lateral core portion 28. The driving shaft 8 passes through the lateral core portion 28 so as to be capable of displacing in the axis line direction. In this example, a bearing is provided on the support plate 7 and the driving shaft 8 passes through the bearing. Each of the longitudinal core portions 29 is located along the axis line direction. At least the first fixed core portion 26 is overlapped with a region of the movable core 20 within a projected surface in the axis line direction.

Each of the second fixed core portions 27 is joined to one longitudinal core portion 29 and the other longitudinal core portion 29. Furthermore, each second fixed core portion 27 sandwiches each longitudinal core portion 29 in a direction perpendicular to the axis line direction. In addition, each second fixed core portion 27 is located out of the region of the movable core 20 within the projected surface in the axis line direction. Further, each second fixed core portion 27 has a yoke core portion 30 parallel to the lateral core portion 28 and a pair of spacers 31 each intervening between the yoke core portion 30 and each longitudinal core portion 29.

Each yoke core portion 30 is located spaced apart from the major portion 23 in a direction perpendicular to the axis line direction. Therefore, the distance between the yoke core portion 30 and the major portion 23 does not change even when the movable core 20 is displaced in the axis line direction. Material of each yoke core portion 30 and the spacer 31 is magnetic material such as steel material, electromagnetic soft iron, silicon steel, ferrite, and permalloy.

A first fixed surface 32 is provided on an intermediate portion of the lateral core portion 28 and a second fixed surface 33 is provided on an end section of each longitudinal core portion 29 (FIG. 3). That is, the first fixed surface 32 and the second fixed surfaces 33 are provided on the first fixed core portion 26 so as to be at positions separated from each other when the first fixed surface 32 and the second fixed surfaces 33 are projected in the axis line direction. The first fixed surface 32 and each second fixed surface 33 are surfaces perpendicular to the axis line direction.

A first movable surface 34 which faces the first fixed surface 32 in the axis line direction is provided on the major portion 23; and a second movable surface 35 which faces the second fixed surface 33 in the axis line direction is provided on an end section of each branch portion 24. The first movable surface 34 and each second movable surface 35 are surfaces perpendicular to the axis line direction.

The permanent magnet 22 is provided on each yoke core portion 30; and the permanent magnet 22 is located between each yoke core portion 30 and the major portion 23. Further, each permanent magnet 22 is located out of the region of the first movable surface 34 and the second movable surface 35 within a projected surface in the axis line direction. In this example, each permanent magnet 22 is located out of the region of the movable core 20 within the projected surface in the axis line direction.

Each permanent magnet 22 has an N pole and an S pole (a pair of magnetic poles). Accordingly, the permanent magnet 22 generates holding magnetic flux which holds the movable core 20 at the forward movement position. Furthermore, in each permanent magnet 22, only either N pole or S pole is located facing the major portion 23 in a direction perpendicular to the axis line direction. That is, a direction of the holding magnetic flux generated by each permanent magnet 22 is substantially perpendicular to the axis line direction between the permanent magnet 22 and the major portion 23. In this example, the N pole of each permanent magnet 22 faces the major portion 23 and the S pole of each permanent magnet 22 is fixed to the yoke core portion 30.

The electromagnetic coil 21 is located so as to pass through between the major portion 23 and the longitudinal core portion 29. In this example, the electromagnetic coil 21 surrounds the major portion 23 within a projected surface in the axis line direction. Accordingly, when the electromagnetic coil 21 is energized, the electromagnetic coil 21 generates magnetic flux which passes through the fixed core 19 and the movable core 20. Furthermore, a direction of the magnetic flux generated by the electromagnetic coil 21 can be inverted by switching of an energization direction to the electromagnetic coil 21. Incidentally, a central axis line of the electromagnetic coil 21 substantially coincides with an axis line of the switch device 1.

The major portion 23 and the branch portion 24 of the movable core 20 are a laminated body in which a plurality of thin sheets made of magnetic material are laminated in a direction perpendicular to the axis line direction.

Incidentally, a magnetic material with high permeability may be acceptable as a material of the major portion 23 and the branch portion 24 of the movable core 20; and, for example, steel material, electromagnetic soft iron, silicon steel, ferrite, and permalloy may be included. Furthermore, for example, the movable core 20 may be made of dust core in which iron powder is compressed and hardened. The first fixed core portion 26 is a laminated body in which thin sheets of magnetic material are laminated in a direction perpendicular to the axis line direction.

Each yoke core portion 30 is a steel member formed in a rectangular parallelepiped shape. The spacer 31 is a steel member formed in a plate shape having a predetermined thickness. The yoke core portion 30 and the spacer 31 are overlapped with the first fixed core portion 26 in the order of the spacer 31 and the yoke core portion 30 in the lamination direction of the thin sheets 39 of the first fixed core portion 26.

Incidentally, a magnetic material with high permeability may be acceptable as a material of the fixed core 19; and, for example, steel material, electromagnetic soft iron, silicon steel, ferrite, and permalloy may be included. Furthermore, for example, the fixed core 19 may be made of dust core in which iron powder is compressed and hardened. Further, in this example, the first fixed core portion 26 is produced by laminating thin sheets; however, the first fixed core portion 26 may be produced by integrally forming magnetic material or the first fixed core portion 26 may be produced by combining a plurality of divided bodies. Furthermore, in this example, the yoke core portion 30 is produced by integrally forming magnetic material; however, the yoke core portion 30 may be produced by laminating thin sheets or the yoke core portion 30 may be produced by combining a plurality of divided bodies.

One seating surface of the open spring 9 comes into contact with the bulk material 101 of the movable core 20, and the other seating surface comes into contact with the support plate 7. The open spring 9 is coaxially located with the driving shaft 8 and is located so as to passes through in the electromagnetic coil 21. Furthermore, the open spring 9 is located within an axial range of the fixed core 19. A part of the major portion 23 of the movable core 20 passes through the electromagnetic coil 21. In FIG. 3, arrangement is made in the order of the open spring 9, the movable core 20, the electromagnetic coil 21, and the fixed core 19 from the driving shaft 8 within an axial existing range of the electromagnetic coil 21.

Figure 6:
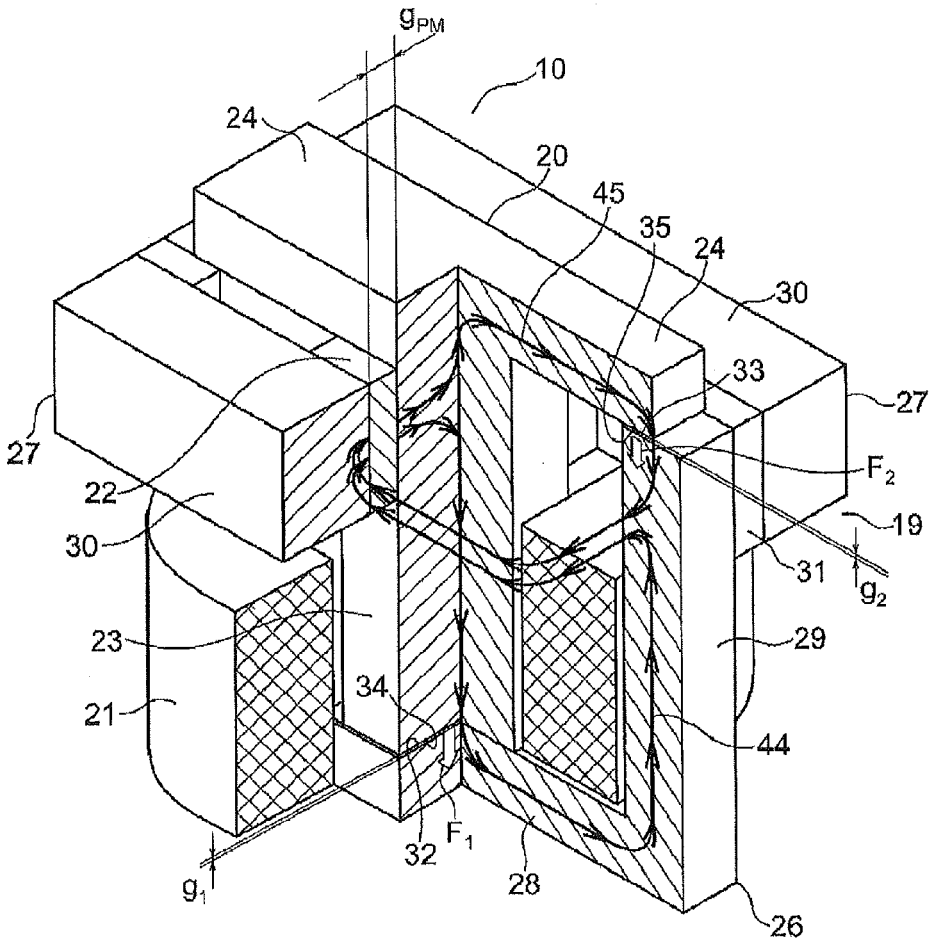
FIG. 6 is a partially broken perspective view for explaining a magnetic circuit of the electromagnet.

FIG. 6 is a partially broken perspective view for explaining a magnetic circuit of the electromagnet 10 at the time when the movable core 20 of FIG. 5 is held at the forward movement position by the holding magnetic flux of the permanent magnets 22; and the driving shaft 8, the open spring 9, the bulk material 101 of the movable core 20 are omitted from the drawing. In the drawing, the holding magnetic flux generated by the permanent magnet 22 passes through a first magnetic flux path 44 or a second magnetic flux path 45. The first magnetic flux path 44 is a path in which the holding magnetic flux passes through in the order of the major portion 23, the first movable surface 34, the first fixed surface 32, the lateral core portion 28, the longitudinal core portions 29, the spacers 31, and the yoke core portions 30 from the permanent magnet 22 and returns to the permanent magnet 22. The second magnetic flux path 45 is a path in which the holding magnetic flux passes through in the order of the major portion 23, the branch portion 24, the second movable surface 35, the second fixed surface 33, the longitudinal core portion 29, the spacer 31, and the yoke core portion 30 from the permanent magnet 22 and returns to the permanent magnet 22.

When the movable core 20 is located at the forward movement position, the gap between the first fixed surface 32 and the first movable surface 34 and the gap between the second fixed surface 33 and the second movable surface 35 are narrower than those when the movable core 20 is located at the backward movement position. Accordingly, magnetic resistance of the first magnetic flux path 44 and the second magnetic flux path 45 becomes small. Therefore, the sucking force F1 between the first fixed surface 32 and the second movable surface 34 and the sucking force F2 between the second fixed surface 33 and the second movable surface 35 become large; and accordingly, the movable core 20 is held at the forward movement position against loads of the open spring 9 and the contact pressure spring 18. Furthermore, a summation of the sucking force F1, the sucking force F2, and the frictional force of the movable portion becomes not lower than the loads of the open spring 9 and the contact pressure spring 19; and thus the movable core 20 is held at the forward movement position.

Next, operation will be described. In the case of an opened state where the movable contact 3 is separated from the fixed contact 2, the movable core 20 is displaced to the backward movement position by the load of the open spring 9. The movable core 20 is sucked to the first fixed core portion 26 by energization to the electromagnetic coil 21; and thus, the movable core 20 is displaced from the backward movement position toward the forward movement position against the load of the open spring 9. Accordingly, the movable contact 3 is displaced toward the fixed contact 2.

After that, when the movable contact 3 comes into contact with the fixed contact 2, the displacement of the movable contact 3 is stopped. However, the movable core 20 is further displaced and reaches the forward movement position. Accordingly, the contact pressure spring 18 is shrunk and the movable contact 3 is pressed to the fixed contact 2 to complete the contact closing operation (FIG. 2).

When the movable core 20 reaches the forward movement position, the movable core 20 is sucked and held to the first fixed core portion 26 by the holding magnetic flux of the permanent magnets 22, the holding magnetic flux passing through the first magnetic flux path 44 and the second magnetic flux path 45 (FIG. 6); and thus, the movable core 20 is held at the forward movement position.

In the case where the holding of the movable core 20 at the forward movement position is released, energization to the electromagnetic coil 21 is performed in a direction opposite to the case of the contact closing operation. When the energization to the electromagnetic coil 21 is performed, the sucking force between the movable core 20 and the first fixed core portion 26 is lowered as the whole and displacement of the movable core 20 from the forward movement position to the backward movement position is started by each load of the open spring 9 and the contact pressure spring 18. At this time, the movable contact 3 is being pressed to the fixed contact 2.

After that, when the movable core 20 is further displaced toward the backward movement position, the latch plate 17 is engaged with the spring frame 16. Also, after that, the movable core 20 is displaced toward the backward movement position; and accordingly, the movable contact 3 is separated from the fixed contact 2. The load of the open spring 9 is larger than the force in which the movable contact 3 of the vacuum valve 4 tries to close to the fixed contact 2. After that, the movable core 20 is further displaced to reach the backward movement position. Accordingly, the opening operation is completed (FIG. 1).

In such electromagnet device 5, in an open contact state (FIG. 1), the load of the open spring 9 is larger than a load in which the movable contact 3 tries to close to the fixed contact 2 so as to be exerted in the contact closing direction, due to negative pressure because the vacuum valve 4 is a vacuum vessel; and accordingly, the open contact state can be stably maintained. Furthermore, even when a summation of the frictional force of the movable portion and the load of the open spring 9 is larger than the load in which the movable contact 3 tries to close to the fixed contact 2 so as to be exerted in the contact closing direction, due to the negative pressure of the vacuum vessel of the vacuum valve 4, the open contact state can be stably maintained.

On the other hand, in the close contact state (FIG. 2), the permanent magnet 22 generates the holding magnetic flux which holds the movable core 20 at the forward movement position. The sucking force F1 and the sucking force F2, both sucking forces being served as a load generated to the contact closing direction by the magnetic flux of the permanent magnets 22, are exerted on the movable core 20 and the load is larger than a summation of loads of the open spring 9 and the contact pressure spring 18; and therefore, the close contact state can be stably maintained. Furthermore, even when the summation of the sucking force F1, the sucking force F2, and the frictional force of the movable portion is not lower than the summation of the loads of the open spring 9 and the contact pressure spring 19, the close contact state can be stably maintained.

The load of the open spring 9 is exerted on the whole range of a movable range of the movable core 20; on the other hand, the load of the contact pressure spring 18 is exerted on a part of the movable range of the movable core 20; and accordingly, the whole length of the open spring 9 is longer than that of the contact pressure spring 18. Furthermore, the open spring 9 is coaxially located with the driving shaft 8 and located so as to pass through in the electromagnetic coil 21. The open spring 9 is located within an axial range of the fixed core 19. A part of the major portion 23 of the movable core 20 passes through the electromagnetic coil 21. In FIG. 3, arrangement is made in the order of the open spring 9, the movable core 20, the electromagnetic coil 21, and the fixed core 19 from the driving shaft 8 in an axial existing range of the electromagnetic coil 21. By the aforementioned arrangement, the axial length of the electromagnet device 5 can be shortened than the case where the electromagnet 10 and the open spring 9 are arranged in the axial direction. Therefore, the whole length of the switch device 1 using this electromagnet device 5 can be shortened.

The major portion 23 and the branch portion 24 of the movable core 20 and the first fixed core portion 26 of the fixed core 19 are main portions where the magnetic flux generated by the electromagnetic coil 21 passes through. The main portions are configured by laminating thin sheets of magnetic material in a substantially direction perpendicular to a direction of the magnetic flux generated by the electromagnetic coil 21; and therefore, when the electromagnetic coil 21 is energized to operate the electromagnet 10, eddy-current generated inside the magnetic material can be suppressed, operational delay due to the occurrence of the eddy-current can be prevented, and the switch device 1 can be driven with temporally high accuracy.

Furthermore, in the magnetic flux generated by the electromagnetic coil 21, the magnetic flux going around just proximal to the electromagnetic coil 21 is the strongest according to the least action principle in physics. The major portion 23 and the branch portions 24 of the movable core 22 are directly faced to the electromagnetic coil 21 and the bulk material 101 is located in a region where the generated magnetic flux is weak; and therefore, influence on the operation of the electromagnet 10 is small and thus the switch device 1 can be driven with temporally high accuracy.

The sucking force generated by the magnetic flux of the permanent magnets of the electromagnet 10 is the strongest when the force is exerted in the axial direction. When a load of a component in a direction perpendicular to the axial direction is applied, the sucking force degrades. Therefore, when the seating surface of the open spring 9 is inclined, the load of the component in the direction perpendicular to the axial direction is generated; and therefore, the inclination of the seating surface needs to be suppressed. One seating surface of the open spring 9 comes into contact with the bulk material 101 of the movable core 20 and the other seating surface comes into contact with the support plate 7; and therefore, the inclination of the seating surface of the open spring 9 can be suppressed than the case where the seating surfaces are received by laminated surfaces of the laminated thin sheets and degradation of the sucking force of the electromagnet 10 due to the inclination of the load of the open spring 9 can be suppressed.

Embodiment 2

Figure 7:
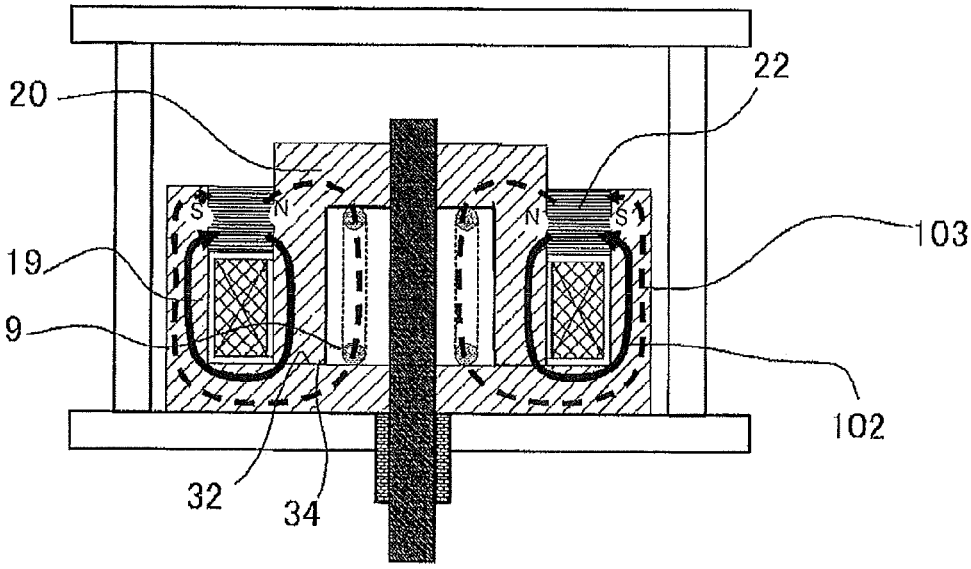
FIG. 7 is a configuration view in the case where the sucking force of the electromagnet degrades.

In the electromagnet device 5 of Embodiment 1, the support plate 7 is made of non-magnetic material; and accordingly, degradation of the sucking force of the electromagnet 10 can be suppressed. The configuration of the case where the sucking force of the electromagnet 10 degrades is shown in FIG. 7 and the principle thereof will be described. FIG. 7 corresponds to a state where the electromagnet 10 of FIG. 3 in Embodiment 1 is in the close contact state. Magnetic flux 102 and magnetic flux 103 of the permanent magnet 22 are shown in FIG. 7. The magnetic flux generated by the permanent magnet 22 is emitted from the N pole of the permanent magnet 22 and passes through a closed circuit configured by magnetic material, the closed circuit being a circuit in which, mainly, non-magnetic region becomes the least. The magnetic flux 102 and the magnetic flux 103 pass through magnetic material portions in FIG. 7. More specifically, the magnetic flux 102 passes through the movable core 20 and the fixed core 19. The magnetic flux 103 passes through the movable core 20, the open spring 9, and the fixed core 19. The magnetic flux 102 passes through the first fixed surface 32 of the fixed core 19 perpendicular to the axis line direction and the first movable surface 34 of the movable core 20. The magnetic flux 102 generated by the permanent magnet 22 passes through the first fixed surface 32 of the fixed core 19 and the first movable surface 34 of the movable core 20; and accordingly, a force which sucks the movable core 20 to the fixed core 19 is generated. On the other hand, the magnetic flux 103 does not pass through the surface in which the movable core 20 comes into contact with the fixed core 19, the surface being perpendicular to the axial direction; and therefore, the force which sucks the movable core 20 to the fixed core 19 is not generated. That is, a part of the magnetic flux generated by the permanent magnet 22 does not contribute to the force which sucks the movable core 20 to the fixed core 19. Furthermore, approximately, the amount of the magnetic flux generated by the permanent magnet 22 is constant. In the case where there exists the magnetic flux 103 which does not pass through the surface at which the movable core 20 is sucked to the fixed core 19, all the magnetic flux generated by the permanent magnet 22 does not contribute to the force which sucks the movable core 20 to the fixed core 19; and therefore, it becomes a configuration with low efficiency from the view point of the sucking force.

In FIG. 3, if the support plate 7 is made of non-magnetic material, a part of the magnetic material's closed circuit in which the magnetic flux generated by the permanent magnet 22 passes through the open spring 9 is non-magnetized and a path of the magnetic flux 103 can be reduced; and therefore, the degradation of the sucking force of the electromagnet 10 can be suppressed. The generation of the sucking force due to the magnetic flux generated by the permanent magnet 22 can be highly efficient and a stable sucking force with higher strength can be generated.

Embodiment 3

In the electromagnet device 5 of Embodiment 1, the bulk material 101 of the movable core 20 of the electromagnet 10 is made of non-magnetic material; and accordingly, a part of the magnetic material's closed circuit in which the magnetic flux generated by the permanent magnet 22 passes through the open spring 9 is non-magnetized and thus degradation of the sucking force of the electromagnet 10 can be suppressed as in Embodiment 2.

Embodiment 4

The driving shaft 8 is made of non-magnetic material in Embodiment 1; however, in the configuration of Embodiment 2 or Embodiment 3, the driving shaft 8 can use steel material serving as magnetic material. The reason is that the support plate 7 or the bulk material 101, which is made of non-magnetic material, exists between paths of the permanent magnet 22 and the driving shaft 8 and therefore the support plate 7 or the bulk material 101 does not become the path of the magnetic flux generated by the permanent magnet 22; and thus, the sucking force of the movable core 20 and the fixed core 19 does not degraded by the fact that the driving shaft 8 is made of magnetic material. Magnetic material can be adopted for the driving shaft 8; and accordingly, a low cost and high strength steel material can be used for the driving shaft 8 and low cost and stable operation of the electromagnet device 5 can be achieved.

Embodiment 5

In the electromagnet device 5 of Embodiment 1, the open spring 9 is made of non-magnetic material; and accordingly, the open spring 9 of the magnetic material's closed circuit in which the magnetic flux generated by the permanent magnet 22 passes through the open spring 9 is non-magnetized and thus degradation of the sucking force of the electromagnet 10 can be suppressed as in Embodiment 2.

Embodiment 6

Figure 8:
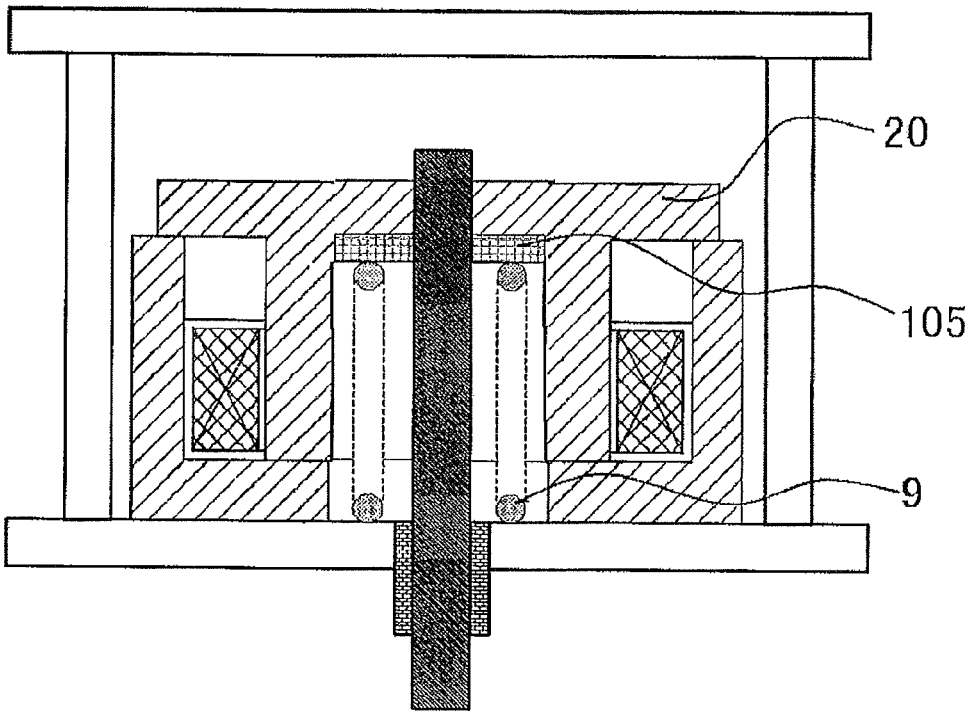
FIG. 8 is a front sectional view showing main portions of an electromagnet device 5 according to Embodiment 6 of the present invention.
Figure 9:
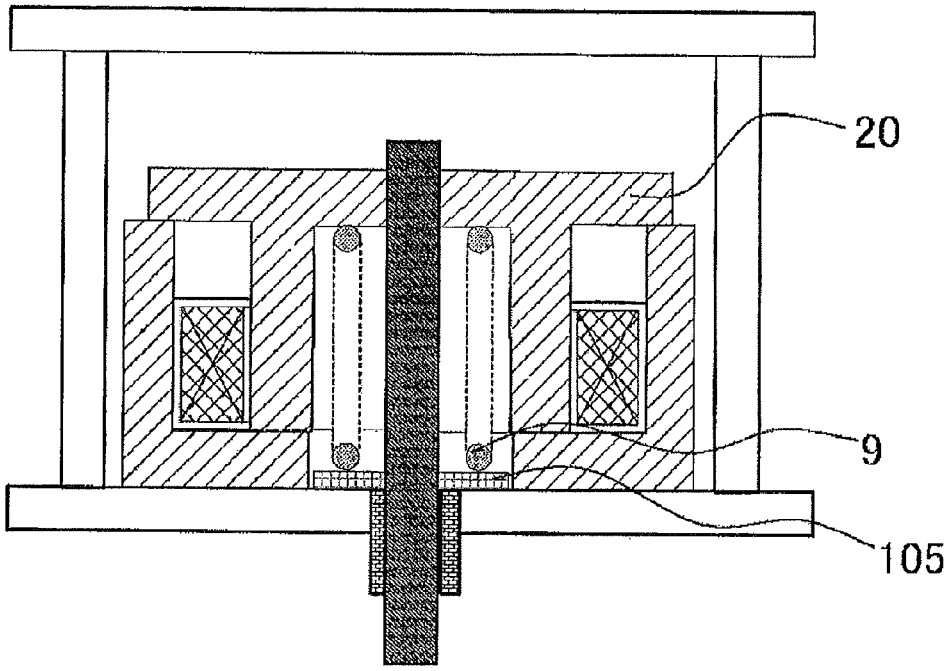
FIG. 9 is a front sectional view showing main portions of an electromagnet device 5 with a different configuration according to Embodiment 6 of the present invention.
Figure 10:
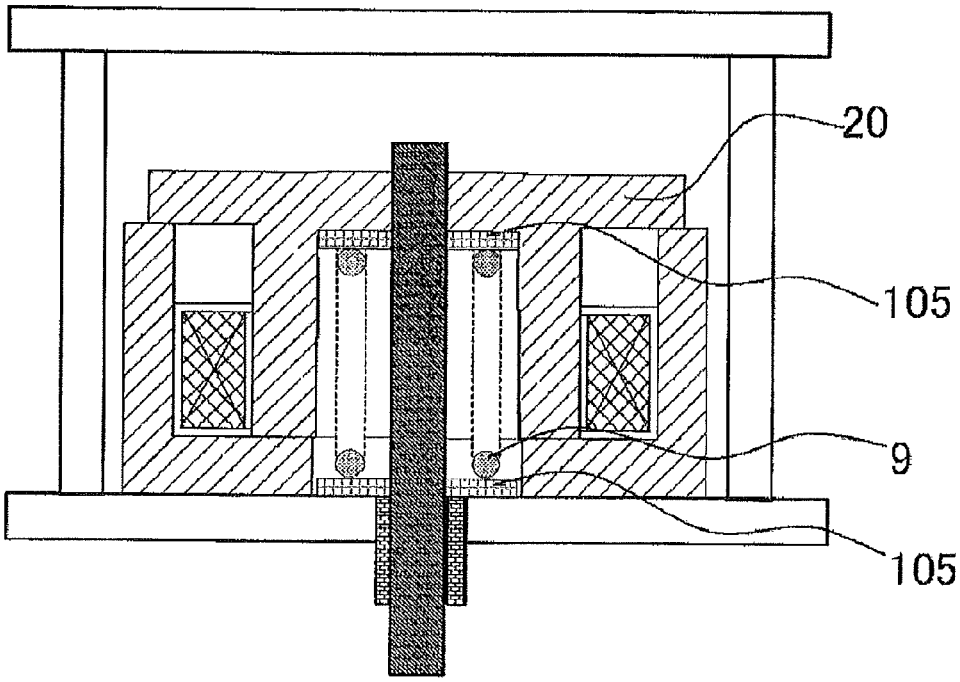
FIG. 10 is a front sectional view showing main portions of an electromagnet device 5 with a different configuration according to Embodiment 6 of the present invention.
Figure 11:
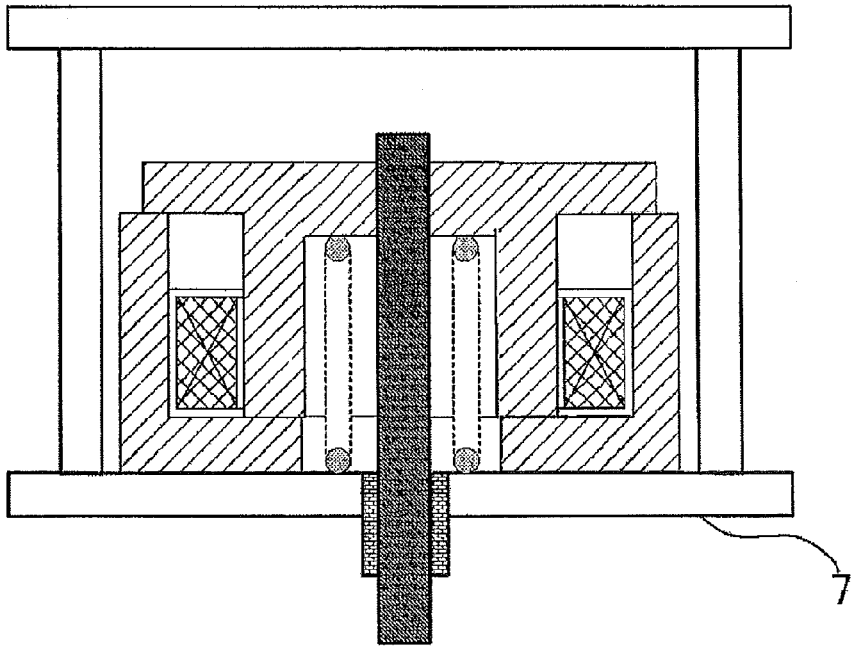
FIG. 11 is a front sectional view showing main portions of an electromagnet device 5 with a different configuration according to Embodiment 6 of the present invention.

FIG. 8 is a front sectional view showing main portions of the electromagnet device 5 according to Embodiment 6 of the present invention. The movable core 20 in FIG. 8 is different from the configuration of FIG. 3 of Embodiment 1; and all the cores including a portion of the bulk material 101 are configured by laminating thin sheets. A non-magnetic material plate 105 is located between a seating surface in which the open spring 9 faces the movable core 20 and the movable core 20. Therefore, a part of a magnetic material's closed circuit in which the magnetic flux generated by the permanent magnet 22 passes through the open spring 9 is non-magnetized; and thus, degradation of the sucking force of the electromagnet 10 can be suppressed as in Embodiment 2. Furthermore, in order to obtain a similar effect, the non-magnetic material plate may be located between the open spring 9 and the support plate 7 as shown in FIG. 9. As shown in FIG. 10, the non-magnetic material plate 105 may be located at the seating surfaces on both sides of the open spring 9. As shown in FIG. 11, the support plate 7 may be made of non-magnetic material.

Embodiment 7

Figure 12:
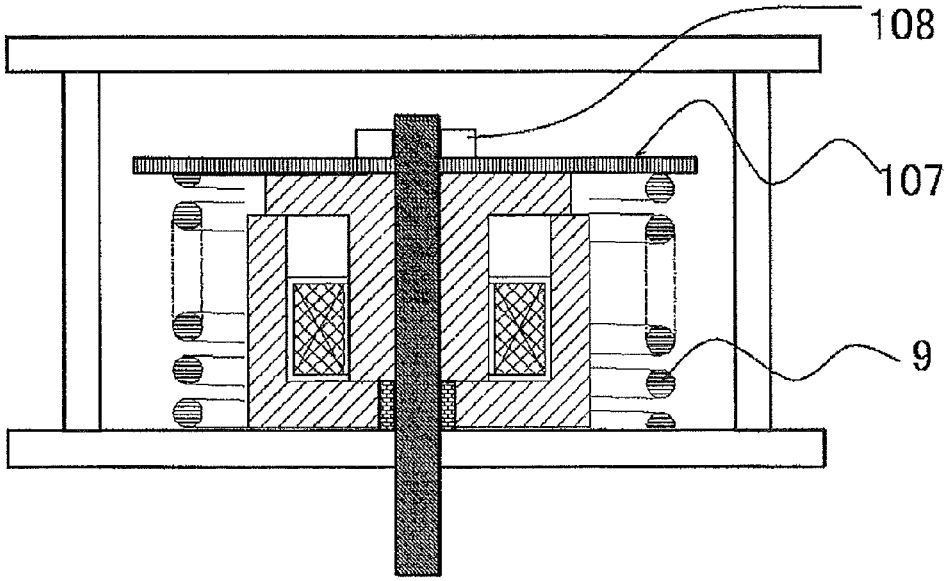
FIG. 12 is a front sectional view showing main portions of an electromagnet device 5 according to Embodiment 7 of the present invention.
Figure 13:
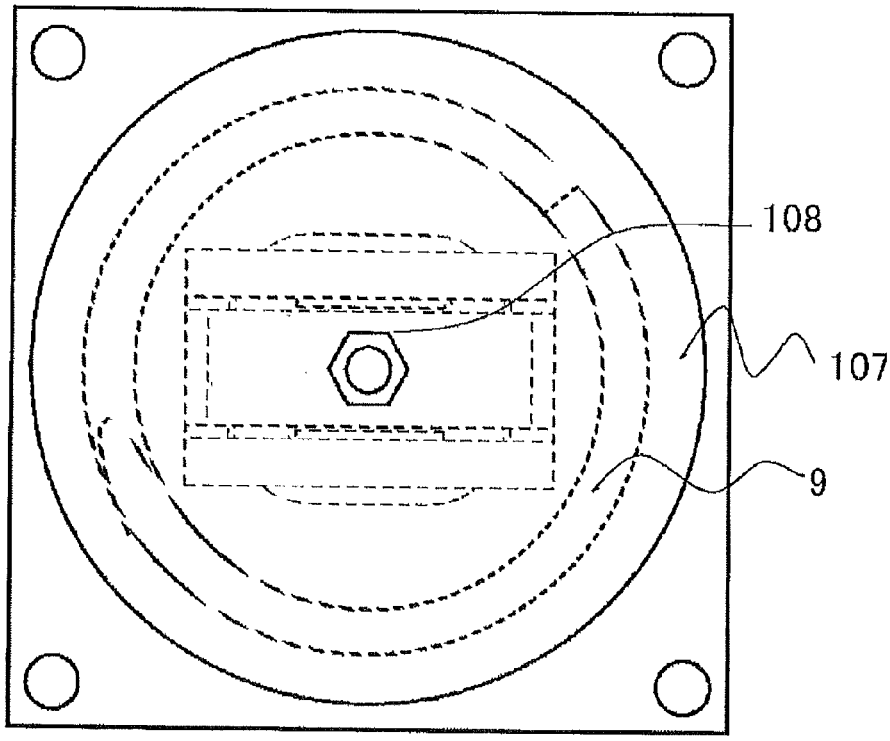
FIG. 13 is a top view showing the main portions of the electromagnet device 5 according to Embodiment 7 of the present invention.

FIG. 12 is a front sectional view showing main portions of the electromagnet device 5 according to Embodiment 7 of the present invention. FIG. 13 is a top view. In FIG. 12, an open spring support 107 is fixed on the branch portions 24 of the movable core 20 by a stopping clamp 108 provided on the opposite side to the surface facing the fixed core 19. The open spring 9 is located coaxially with the driving shaft 8 so as to circle around the electromagnet 10. Arrangement is made in the order of the driving shaft 8, the movable core 20, the electromagnetic coil 21, the fixed core 19, and the open spring 9 in a region where the driving shaft 8, the movable core 20, the electromagnetic coil 21, the fixed core 19, and the open spring 9 are overlapped in the axial direction.

A load of the open spring 9 is exerted on the whole range of a movable range of the movable core 20. On the other hand, a load of the contact pressure spring 18 is exerted on a part of the movable range of the movable core 20; and accordingly, the whole length of the open spring 9 is longer than that of the contact pressure spring 18. Furthermore, the open spring 9 is located coaxially with the driving shaft 8 and located on a peripheral portion of the electromagnet 10. The open spring 9 is located within an axial range of the electromagnet 10. By the aforementioned arrangement, the axial length of the electromagnet device 5 can be shortened than the case where the electromagnet 10 and the open spring 9 are arranged in the axial direction. Therefore, the whole length of the switch device 1 using this electromagnet device 5 can be shortened.

Embodiment 8

Figure 14:
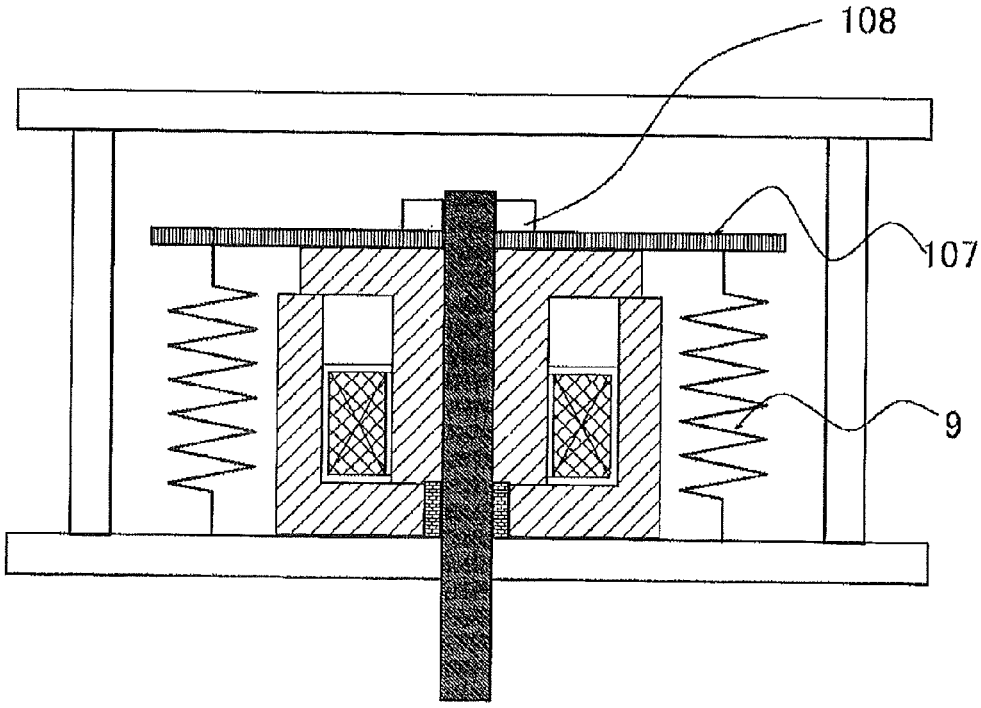
FIG. 14 is a front sectional view showing main portions of an electromagnet device 5 according to Embodiment 8 of the present invention.
Figure 15:
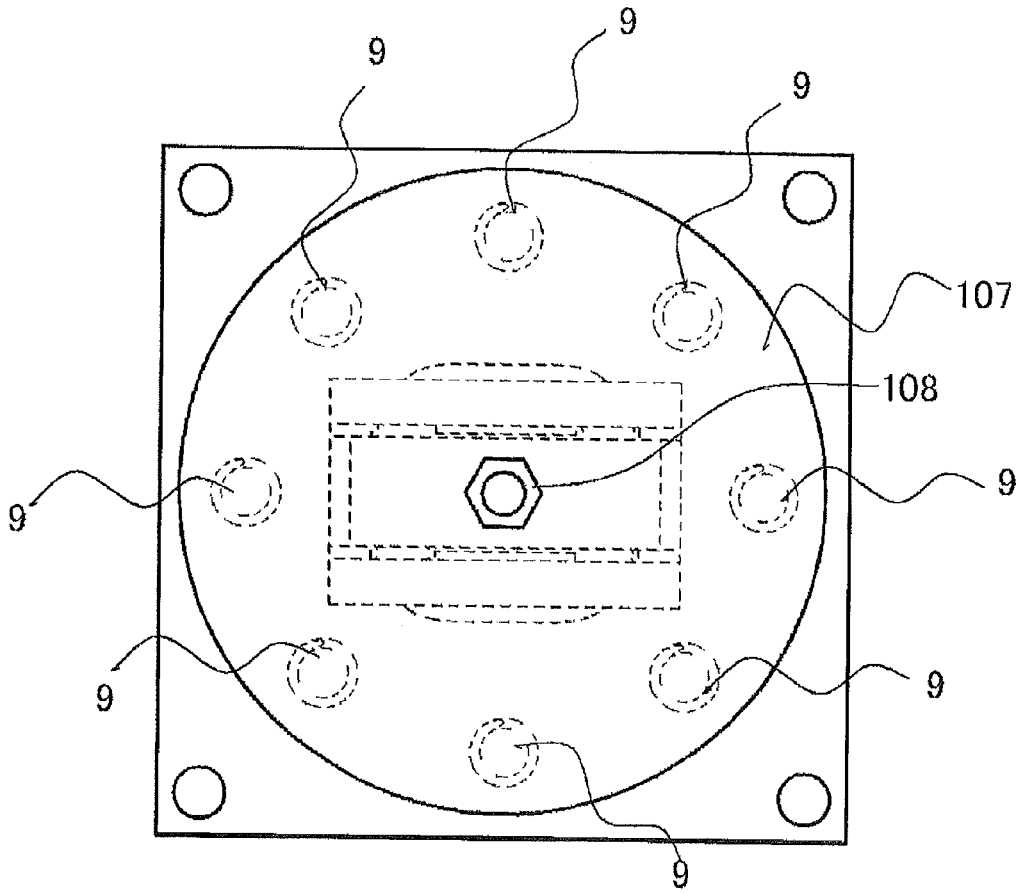
FIG. 15 is a top view showing the main portions of the electromagnet device 5 according to Embodiment 8 of the present invention.

FIG. 14 is a front sectional view showing main portions of the electromagnet device 5 according to Embodiment 8 of the present invention. FIG. 15 is a top view. Embodiment 7 is configured by one open spring 9; however, FIG. 14 is configured by a plurality of open springs 9. Also, in this configuration, a similar effect is exhibited as in Embodiment 7. Furthermore, arrangement is made around the electromagnet 10 so as to be coaxial with the driving shaft 8; and accordingly, variation of a load in each individual open spring 9 can be averaged and an off-centered load with respect to the movable core 20 of the electromagnet 10 is suppressed and thus degradation of the sucking force of the electromagnet 10 can be prevented.

Embodiment 9

Figure 16:
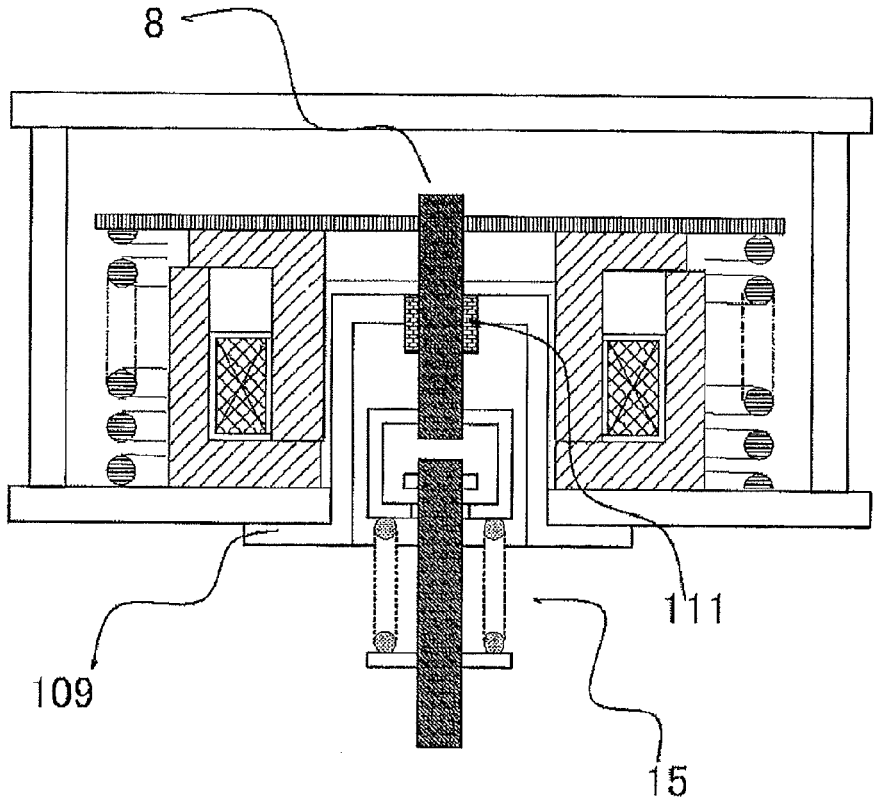
FIG. 16 is a front sectional view showing main portions of an electromagnet device 5 according to Embodiment 9 of the present invention.

FIG. 16 is a front sectional view showing main portions of the electromagnet device 5 according to Embodiment 9 of the present invention. In FIG. 16, a bearing supporting portion 109 fixed to the support plate 7 axially passes through a part of the fixed core 19 of the electromagnet 10 and passes through a part of the movable core 20; and a bearing 111 of the driving shaft 8 is axially located so as to be provided in a range of the movable core. By this arrangement, a contact pressure device 15 can be located inside the bearing supporting portion 109; and the axial length of the electromagnet device 5 can be shortened than the case where the electromagnet 10 and the contact pressure device 15 are axially arranged. Therefore, the whole length of the switch device 1 using this electromagnet device 5 can be further shortened than Embodiment 8.

Embodiment 10

Figure 17:
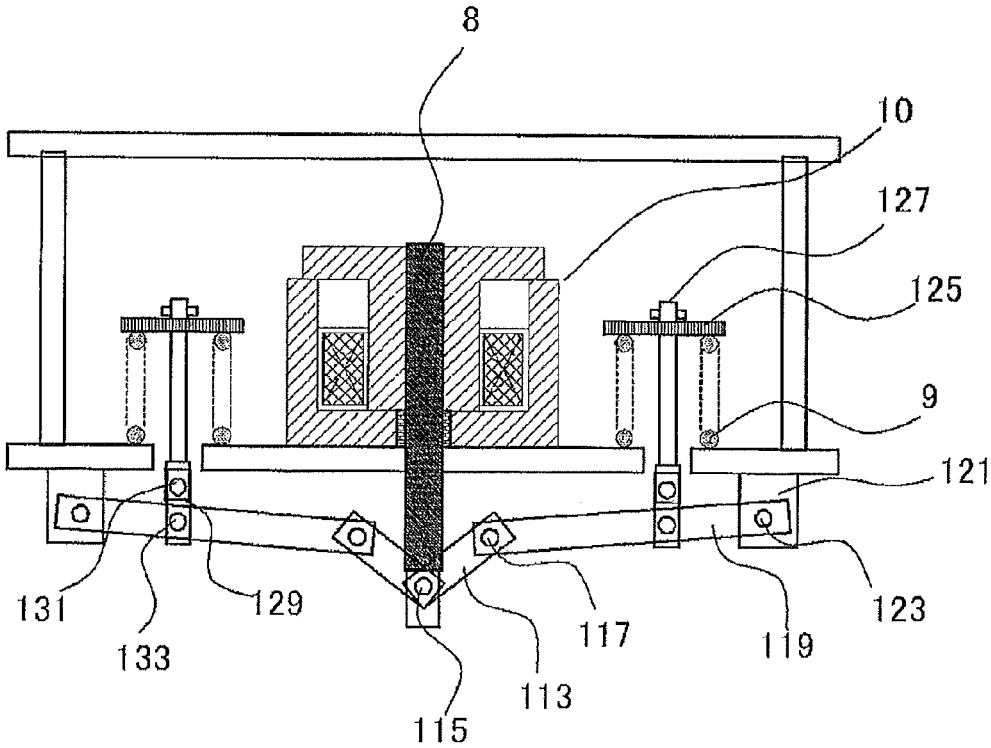
FIG. 17 is a front sectional view showing main portions of an electromagnet device 5 according to Embodiment 10 of the present invention.

FIG. 17 is a front sectional view showing main portions of the electromagnet device 5 according to Embodiment 10 of the present invention. In FIG. 17, in a pair of first connection links 113 symmetrically arranged with respect to the driving shaft 8, one end sections are connected by a pin 115 to the driving shaft 8 connected to a movable core 20. The other end sections of the first connection links 113 are connected to driving levers 119 by pins 117, the driving levers 119 being arranged in pairs at symmetrical positions with respect to the driving shaft 8. The other end sections of the driving levers 119 connected to the first connection links 113 are connected to fulcrum members 121 by pins 123 so as to be capable of pivoting, the fulcrum members 121 being fixed to the support plate 7.

The open springs 9 are divided and are symmetrically arranged with respect to the driving shaft 8. An open spring support 125 which receives a load of the open spring 9 is located coming into contact with the seating surface of the open spring 9 and a driving shaft 127 is attached to the open spring support 125. The other end of the driving shaft 127 is connected to the second connection link 129 by a pin 131. The other end of the second connection link is connected to the driving lever 119 by a pin 133.

In the electromagnet device 5 configured as shown in FIG. 17, arrangement is made in the order of the pin 113 on which the open spring 9 exerts and the pin 115 on which the driving shaft 8 of the electromagnet 10 exerts from the fulcrum member 121; and therefore, a compressed range of the open spring 9 can be reduced with respect to a movable range of the movable core 20 of the electromagnet 10 and thus the open spring 9 can be reduced in size. Furthermore, a portion protruded with respect to the electromagnet 10 can be shortened by the arrangement of the connection links. Therefore, the whole length of this electromagnet device 5 can be shortened, and the whole length of the switch device 1 using this electromagnet device 5 can be shortened.

Embodiment 11

Figure 18:
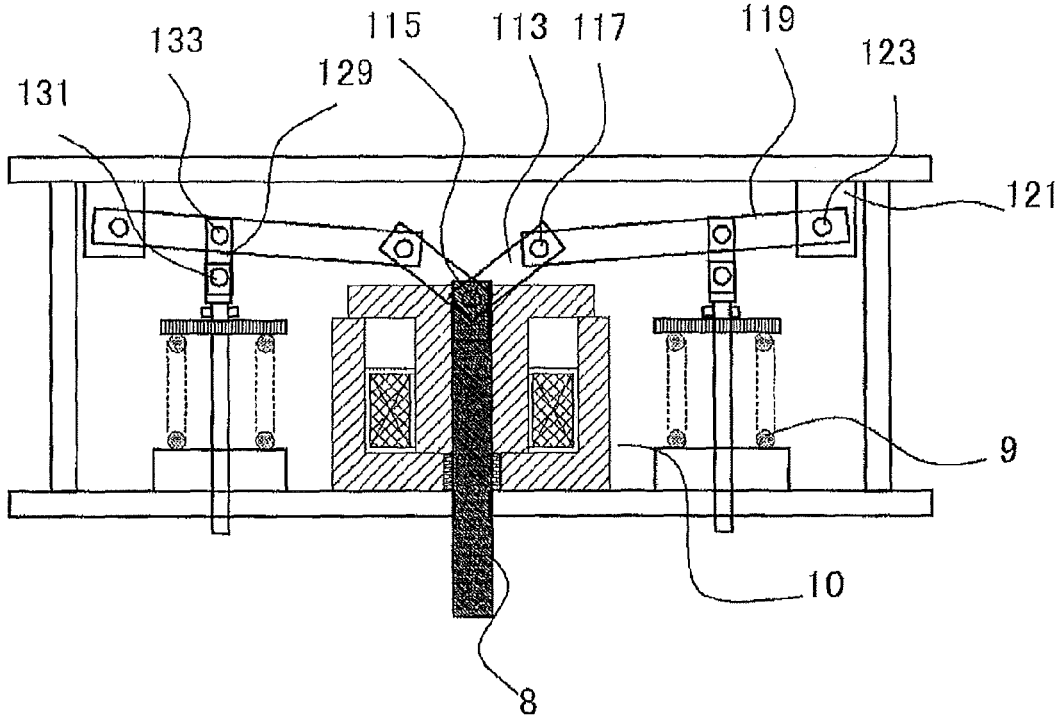
FIG. 18 is a front sectional view showing main portions of an electromagnet device 5 according to Embodiment 11 of the present invention.

FIG. 18 is a front sectional view showing main portions of the electromagnet device 5 according to Embodiment 11 of the present invention. As compared to Embodiment 10, the connection link portions are provided on the open contact side of the electromagnet device 5; and also by this configuration, the whole length of the electromagnet device 5 of the Embodiment 10 can be shortened and the whole length of the switch device 1 using this electromagnet device 5 can be shortened.

Embodiment 12

Any electromagnet device 5 of the aforementioned Embodiment 1 to Embodiment 11 is applied; and accordingly, the whole length of the switch device 1 using the electromagnet device 5 can be shortened and reduction in size can be achieved.

DESCRIPTION OF REFERENCE NUMERALS

1 Switch device,
2 Fixed contact,
3 Movable contact,
5 Electromagnet device,
8 Driving shaft,
9 Open spring,
10 Electromagnet,
19 Fixed core,
20 Movable core,
21 Electromagnetic coil,
22 Permanent magnet,
23 Major portion,
24 Branch portions,
32 First fixed surface,
33 Second fixed surface,
34 First movable surface, and
35 Second movable surface

The invention claimed is:

1. An electromagnet device comprising:
a fixed core;
a movable core;
a permanent magnet in which one surface of magnetic poles faces said movable core and the other surface of the magnetic poles is fixed to said fixed core;
a shaft which is connected to said movable core;
an electromagnetic coil which is located so as to wind around said shaft; and
an open spring which comes into contact with a surface substantially perpendicular to said shaft of said movable core in a movable range of said movable core,
wherein, in the case of being located at one of utmost positions of the movable range of said movable core, one of utmost positions being a position in which said movable core comes into contact with said fixed core,
arrangement is made coaxially in the order of said open spring, said movable core, said electromagnetic coil, and said fixed core from said shaft toward the outside; and
arrangement is made such that the whole or a part of each axial dimension of said open spring, said movable core, said electromagnetic coil, and said fixed core are overlapped with each other in the case of being seen in a radial direction of said shaft.

2. The electromagnet device according to claim 1,
wherein a part or the whole of said fixed core and said movable core is configured by being laminated by magnetic sheets.

3. The electromagnet device according to claim 2,
wherein, in said movable core, the surface which comes into contact with a seating surface of said open spring is made of bulk material.

4. The electromagnet device according to claim 3,
wherein the bulk material of said movable core is non-magnetic material.

5. The electromagnet device according to claim 4,
wherein said shaft connected to said movable core is a steel member having magnetic property.

6. The electromagnet device according to claim 2,
wherein a non-magnetic material plate is located on one or both seating surfaces of said open spring.

7. The electromagnet device according to claim 2,
wherein said open spring is made of non-magnetic material.

8. The electromagnet device according to claim 1,
wherein a surface other than the surface in which said open spring comes into contact with said movable core is a support plate on which said electromagnet device is mounted.

9. The electromagnet device according to claim 8,
wherein said support plate is made of non-magnetic material.

10. The electromagnet device according to claim 9,
wherein said shaft connected to said movable core is a steel member having magnetic property.

11. The electromagnet device according to claim 1,
wherein a non-magnetic material plate is located on one or both seating surfaces of said open spring.

12. The electromagnet device according to claim 1,
wherein said open spring is made of non-magnetic material.

13. A switch device using an electromagnet device as set forth in claim 1.

14. An electromagnet device comprising:
a fixed core;
a movable core;
a permanent magnet in which one surface of magnetic poles faces said movable core and the other surface of the magnetic poles is fixed to said fixed core;
a shaft which is connected to said movable core;
an electromagnetic coil which is located so as to wind around said shaft; and
an open spring which comes into contact with a surface substantially perpendicular to said shaft of said movable core in a movable range of said movable core,
wherein, in the case of being located at one of utmost positions of the movable range of said movable core, one of utmost positions being a position in which said movable core comes into contact with said fixed core,
arrangement is made coaxially in the order of said movable core, said electromagnetic coil, said fixed core, and said open spring from said shaft toward the outside, and the whole or a part of each axial dimension of said movable core, said electromagnetic coil, said fixed core, and said open spring are overlapped with each other in the case of being seen in a radial direction of said shaft;

one or a plurality of said open springs are provided on a peripheral portion of said fixed core centering on said shaft; and a bearing support member mounted on a support plate and equipped with a bearing of said shaft is located passing through a part of said fixed core and a part of said movable core.

15. A switch device using an electromagnet device as set forth in claim 14.

16. An electromagnet comprising:

a movable core; and a shaft which is connected to said movable core, said electromagnet including:

a pair of first connection links which are connected to said shaft;

a pair of driving levers which are arranged at symmetrical positions with respect to said shaft, one end thereof being connected to said first connection link and the other end thereof being connected to a support point of a support portion of said electromagnet by a pin so as to be capable of pivoting;

open springs which are arranged at symmetrical positions with respect to a direction of said shaft connected to said movable core; and a pair of open spring supports, each of which coming into contact with one end of said open spring and being connected to said driving lever, said open spring support and said driving lever being connected by a second connection link by a pin.

17. A switch device using an electromagnet device as set forth in claim 16.

* * * * *